US011339585B1

(12) United States Patent
Wilson et al.

(10) Patent No.: US 11,339,585 B1
(45) Date of Patent: May 24, 2022

(54) FENESTRATION CAM LOCK ASSEMBLIES AND METHODS

(71) Applicant: Andersen Corporation, Bayport, MN (US)

(72) Inventors: Matthew P. Wilson, North St. Paul, MN (US); Ross S. McGruder, Lake Elmo, MN (US)

(73) Assignee: Andersen Corporation, Bayport, MN (US)

( * ) Notice: Subject to any disclaimer, the term of this patent is extended or adjusted under 35 U.S.C. 154(b) by 313 days.

(21) Appl. No.: 16/582,728

(22) Filed: Sep. 25, 2019

Related U.S. Application Data

(63) Continuation of application No. 62/736,797, filed on Sep. 26, 2018.

(51) Int. Cl.
*E05B 15/02* (2006.01)
*E05C 1/10* (2006.01)
*E05B 65/08* (2006.01)

(52) U.S. Cl.
CPC ..... *E05B 15/0205* (2013.01); *E05C 1/10* (2013.01); *E05B 65/0864* (2013.01); *E05B 2015/023* (2013.01); *E05B 2015/026* (2013.01); *E05B 2065/0805* (2013.01); *Y10S 292/20* (2013.01); *Y10S 292/47* (2013.01); *Y10T 292/0962* (2015.04); *Y10T 292/0963* (2015.04); *Y10T 292/0964* (2015.04); *Y10T 292/0969* (2015.04); *Y10T 292/1039* (2015.04); *Y10T 292/1041* (2015.04); *Y10T 292/1075* (2015.04); *Y10T 292/68* (2015.04)

(58) Field of Classification Search
CPC ..... E05B 15/0205; E05B 65/0864; E05B 2015/023; E05B 2015/026; E05B 2065/0805; E05C 1/10; Y10T 292/1041; Y10T 292/1039; Y10T 292/1075; Y10T 292/0886; Y10T 292/096; Y10T 292/0962; Y10T 292/0963; Y10T 292/0964; Y10T 292/0969; Y10S 292/20; Y10S 292/47
See application file for complete search history.

(56) References Cited

U.S. PATENT DOCUMENTS 3,811,718 A 5/1974 Bates
4,095,829 A 6/1978 Van Klompenburg
4,261,602 A * 4/1981 Anderson ..... E05C 1/06 292/143
4,497,135 A 2/1985 Vetter
5,219,193 A * 6/1993 Piltingsrud ..... E05B 13/002 292/106
5,263,346 A * 11/1993 Sato ..... E05B 83/30 292/DIG. 38
5,493,813 A 2/1996 Vetter et al.
5,582,445 A 12/1996 Olsen et al.
6,142,541 A * 11/2000 Rotondi ..... E05C 3/046 292/241
6,412,834 B1 7/2002 Waitai et al.
(Continued)

*Primary Examiner* — Christine M Mills
*Assistant Examiner* — Faria F Ahmad
(74) *Attorney, Agent, or Firm* — Mueting Raasch Group

(57) ABSTRACT

Fenestration lock assemblies, fenestration units including the lock assemblies, and methods of assembling the lock assemblies. The lock assemblies use a cam and follower design that transfers rotary motion to a lock bolt that moves in translation between an extended/locked state and a retracted/unlocked state.

20 Claims, 10 Drawing Sheets

(56) References Cited

U.S. PATENT DOCUMENTS 6,871,885 B2 * 3/2005 Goldenberg ..... E05B 65/0841 292/14
6,871,886 B2 * 3/2005 Coleman ..... E05B 17/2003 292/241
6,877,784 B2 4/2005 Kelley et al.
7,000,957 B2 * 2/2006 Lawrence ..... E05B 65/0841 292/241
7,013,603 B2 3/2006 Eenigenburg et al.
7,070,211 B2 7/2006 Polowinczak et al.
7,322,619 B2 1/2008 Nolte et al.
7,322,620 B1 * 1/2008 Lawrence ..... E05B 17/208 292/240
7,383,707 B2 * 6/2008 Yamada ..... E05B 83/30 292/167
7,407,199 B2 * 8/2008 Richardson ..... E05B 63/20 292/163
7,591,494 B2 * 9/2009 Mitchell ..... E05B 63/185 292/336
7,607,262 B2 10/2009 Pettit et al.
7,665,775 B1 * 2/2010 Miller ..... E05B 65/0841 292/240
7,676,990 B2 * 3/2010 Bestler ..... E05B 65/0864 49/449
7,922,223 B2 * 4/2011 Lawrence ..... E05C 3/046 292/241
7,963,577 B2 6/2011 Wolf
8,002,317 B2 8/2011 Satram et al.
8,269,627 B2 9/2012 Gore et al.
8,567,830 B2 * 10/2013 Liang ..... E05C 3/046 292/240
10,633,897 B2 * 4/2020 Liang ..... E05B 17/2038
2002/0171248 A1 * 11/2002 Diss ..... E05B 77/38 292/164
2004/0026932 A1 * 2/2004 Coleman ..... E05B 17/2003 292/241
2004/0207212 A1 * 10/2004 Wallis ..... E05C 1/12 292/241
2005/0006906 A1 * 1/2005 Yamada ..... E05B 83/30 292/63
2005/0121923 A1 * 6/2005 Lawrence ..... E05B 65/0841 292/240
2006/0033345 A1 * 2/2006 Richardson ..... E05B 63/20 292/175
2006/0087130 A1 * 4/2006 Liang ..... E05B 15/102 292/242
2006/0192391 A1 * 8/2006 Pettit ..... E05C 9/046 292/5
2007/0085350 A1 * 4/2007 Liang ..... E05B 41/00 292/240
2008/0012357 A1 * 1/2008 Liang ..... E05B 41/00 292/240
2008/0129054 A1 * 6/2008 Tremble ..... E05B 5/003 292/33
2008/0246287 A1 * 10/2008 Satram ..... E05B 15/025 292/158
2009/0127872 A1 * 5/2009 Ye ..... E05B 65/0864 292/241
2009/0189398 A1 * 7/2009 Lawrence ..... E05B 65/0841 292/241
2011/0221211 A1 * 9/2011 Weron ..... E05B 63/20 292/64
2011/0298225 A1 * 12/2011 Liang ..... E05B 9/00 292/175
2011/0304163 A1 * 12/2011 Liang ..... E05C 3/046 292/242
2013/0283694 A1 * 10/2013 DeBoer ..... E05C 3/12 49/186

* cited by examiner

FENESTRATION CAM LOCK ASSEMBLIES AND METHODS

RELATED APPLICATION

This application claims the benefit under 35 U.S.C. Section 119 of U.S. Provisional Patent Application Ser. No. 62/736,797 entitled "FENESTRATION LOCK ASSEMBLIES AND METHODS" and filed on Sep. 26, 2018, which is incorporated herein by reference in its entirety.

Fenestration lock assemblies, fenestration units including the fenestration lock assemblies, and methods of assembling the same are described herein.

Lock assemblies used in fenestration units often use rotating cams that are captured by keepers. One potential drawback of such lock assemblies is the need for precise alignment between the rotating cam and the keeper. The alignment requirements may be difficult and/or expensive to achieve. Examples of such lock assemblies may be found in, e.g., U.S. Pat. Nos. 3,811,718; 4,095,829; 5,582,445; etc.

SUMMARY

Fenestration lock assemblies, fenestration units including the lock assemblies, and methods of assembling the lock assemblies are described herein.

In one or more embodiments, the fenestration lock assemblies described herein may be used to secure a first frame member of a fenestration unit (e.g., a window) to a keeper attached to a second frame member of the fenestration unit and thereby preventing movement of the first and second frame members relative to each other in a manner that would open the window on which the fenestration lock assembly is mounted.

The lock assemblies described herein accommodate a relatively large variability in the sash positions when moving the lock assembly from the unlocked to the locked state. In one or more embodiments, the lock assemblies use a cam and follower design that transfers rotary motion commonly associated with fenestration lock assemblies to a lock bolt that moves in translation between an extended/locked state and a retracted/unlocked state.

In one or more embodiments, the lock assemblies described herein may be used with a variety of cover in handle styles, finishes, etc. without affecting the operation of the lock assembly.

Further, one or more embodiments of the lock assemblies described herein may include nonvisible tamper resistance countermeasures that could be incorporated into any number of parts within the lock assembly.

In a first aspect, one or more embodiments of a fenestration lock assembly as described herein may include: a housing comprising a base and a cover, the housing configured to be secured to the first window frame member and defining an internal space; a lock bolt slidably mounted in the internal space of the housing and configured to move in alternate rearward and forward directions along a locking axis between a retracted position and an extended position, the lock bolt in the extended position configured to extend in the forward direction from the housing to engage the keeper, and the lock bolt in the retracted position configured to retract in the rearward direction at least partially into the housing to disengage the keeper; a rotatable handle operably connected to the cover of the housing, the handle comprising a shaft and a lever portion, the handle configured to rotate the shaft about a shaft axis as the handle portion rotates about the shaft axis, wherein the shaft axis is generally transverse to the locking axis; a rotatable cam connected to the shaft of the handle, wherein the cam is configured to rotate about the shaft axis with the shaft as the lever portion of the handle is rotated about the shaft axis; and a follower in the internal space of the housing, wherein rotation of the cam about the shaft axis moves the follower along the locking axis, and wherein the follower moves the lock bolt between the retracted position and the extended position along the locking axis as the cam rotates about the shaft axis.

In one or more embodiments of the fenestration lock assemblies described herein, the rotatable handle is configured to rotate about the shaft axis between an unlocked position and a locked position, wherein the lock bolt is in the retracted position when the handle is in the unlocked position, and wherein the lock bolt is in the extended position when the handle is in the locked position.

In one or more embodiments of the fenestration lock assemblies described herein, the cam comprises a stop arm extending away from the shaft axis in a generally radial direction, and wherein the housing comprises a first stop positioned such that the first stop limits further rotation of the handle as the handle is rotated from the locked position to the unlocked position, and wherein the housing comprises a second stop positioned such that the first stop limits further rotation of the handle as the handle is rotated from the unlocked position to the locked position. In one or more embodiments, the first stop and the second stop extend from the cover towards the base of the housing.

In one or more embodiments of the fenestration lock assemblies described herein, the fenestration lock assembly comprises a biasing element located in the base of the housing, the biasing element acting on the lock bolt and configured to apply a biasing force on the lock bolt in a direction that moves the lock bolt to the extended position. In one or more embodiments, the biasing force alone cannot cause the cam to rotate the handle from the unlocked position to the locked position. In one or more embodiments, the biasing element comprises a coil spring.

In one or more embodiments of the fenestration lock assemblies described herein, the follower is separate and discrete from the lock bolt.

In one or more embodiments of the fenestration lock assemblies described herein, the follower comprises a pin, and wherein the pin is received in a recess in the lock bolt, wherein the pin of the follower acts on the recess of the lock bolt to move the lock bolt between the retracted position and the extended position along the locking axis as the cam rotates about the cam axis.

In one or more embodiments of the fenestration lock assemblies described herein, the fenestration lock assembly further comprises a detent washer connected to the shaft of the handle such that rotation of the shaft about the shaft axis rotates the detent washer about the shaft axis, wherein the housing comprises a detent washer cavity in which the detent washer is located, wherein the detent washer is retained in a locked configuration in the detent washer cavity when the lock bolt is in the extended position until the handle is manually rotated about the shaft axis; and wherein the detent washer is retained in an unlocked configuration in the detent washer cavity when the lock bolt is in the retracted position until the handle is manually rotated about the shaft axis. In one or more embodiments, the detent washer and the detent washer cavity comprise complementary mating protrusions and recesses that mate when the detent washer and the detent washer cavity are retained in the locked configuration and when detent washer is retained in the unlocked configuration in the detent washer cavity. In one or more embodiments, the detent washer and the detent washer cavity comprise complementary mating protrusions and recesses that do not mate when the detent washer is not in the locked configuration or the unlocked configuration in the detent washer cavity.

In a second aspect, one or more embodiments of a fenestration lock assembly as described herein may include: a housing comprising a base and a cover, the housing configured to be secured to the first window frame member and defining an internal space; a lock bolt slidably mounted in the internal space of the housing and configured to move in alternate rearward and forward directions along a locking axis between a retracted position and an extended position, the lock bolt in the extended position configured to extend in the forward direction from the housing to engage the keeper, and the lock bolt in the retracted position configured to retract in the rearward direction at least partially into the housing to disengage the keeper; a rotatable handle operably connected to the cover of the housing, the handle comprising a shaft and a lever portion, the handle configured to rotate the shaft about a shaft axis as the handle portion rotates about the shaft axis, wherein the shaft axis is generally transverse to the locking axis; a rotatable cam connected to the shaft of the handle, wherein the cam is configured to rotate about the shaft axis with the shaft as the lever portion of the handle is rotated about the shaft axis; a follower in the internal space of the housing, wherein rotation of the cam about the shaft axis slides the follower along the locking axis, and wherein the follower moves the lock bolt between the retracted position and the extended position along the locking axis as the cam rotates about the shaft axis; a detent washer connected to the shaft of the handle such that rotation of the shaft about the shaft axis rotates the detent washer about the shaft axis; a detent washer cavity in the housing, wherein the detent washer is located in the detent washer cavity, and wherein the detent washer is retained in a locked configuration in the detent washer cavity when the lock bolt is in the extended position until the handle is manually rotated about the shaft axis; and wherein the detent washer is retained in an unlocked configuration in the detent washer cavity when the lock bolt is in the retracted position until the handle is manually rotated about the shaft axis; and a biasing element located in the base of the housing, the biasing element acting on the lock bolt and configured to apply a biasing force on the lock bolt in a direction that moves the lock bolt to the extended him position, and wherein the biasing force alone cannot move the detent washer and the detent washer cavity out of the unlocked configuration.

In one or more embodiments of the fenestration lock assemblies described herein, the rotatable handle is configured to rotate about the shaft axis between an unlocked position and a locked position, wherein the lock bolt is in the retracted position when the handle is in the unlocked position, and wherein the lock bolt is in the extended position when the handle is in the locked position.

In one or more embodiments of the fenestration lock assemblies described herein, the cam comprises a stop arm extending away from the shaft axis in a generally radial direction, and wherein the housing comprises a first stop positioned such that the first stop limits further rotation of the handle as the handle is rotated from the locked position to the unlocked position, and wherein the housing comprises a second stop positioned such that the first stop limits further rotation of the handle as the handle is rotated from the unlocked position to the locked position. In one or more embodiments, the first stop and the second stop extend from the cover towards the base of the housing.

In one or more embodiments of the fenestration lock assemblies described herein, the biasing element comprises a coil spring.

In one or more embodiments of the fenestration lock assemblies described herein, the follower is separate and discrete from the lock bolt.

In one or more embodiments of the fenestration lock assemblies described herein, the follower comprises a pin, and wherein the pin is received in a recess in the lock bolt, wherein the pin of the follower acts on the recess of the lock bolt to move the lock bolt between the retracted position and the extended position along the locking axis as the cam rotates about the cam axis.

In one or more embodiments of the fenestration lock assemblies described herein, the detent washer and the detent washer cavity comprise complementary mating protrusions and recesses that mate when the detent washer is retained in the locked configuration in the detent washer cavity and when the detent washer is retained in the unlocked configuration in the detent washer cavity. In one or more embodiments, the detent washer and the detent washer cavity comprise complementary mating protrusions and recesses that do not mate when the detent washer is not in the locked configuration or the unlocked configuration in the detent washer cavity.

As used herein and in the appended claims, the singular forms "a," "an," and "the" include plural referents unless the context clearly dictates otherwise. Thus, for example, reference to "a" or "the" component may include one or more of the components and equivalents thereof known to those skilled in the art. Further, the term "and/or" means one or all of the listed elements or a combination of any two or more of the listed elements.

It is noted that the term "comprises" and variations thereof do not have a limiting meaning where these terms appear in the accompanying description. Moreover, "a," "an," "the," "at least one," and "one or more" are used interchangeably herein.

The above summary is not intended to describe each embodiment or every implementation of the fenestration lock assemblies, fenestration units including the lock assemblies, and methods of assembling the fenestration lock assemblies described herein. Rather, a more complete understanding of the invention will become apparent and appreciated by reference to the following Description of Illustrative Embodiments and claims in view of the accompanying figures of the drawing.

DESCRIPTION OF ILLUSTRATIVE EMBODIMENTS

Figure 1:
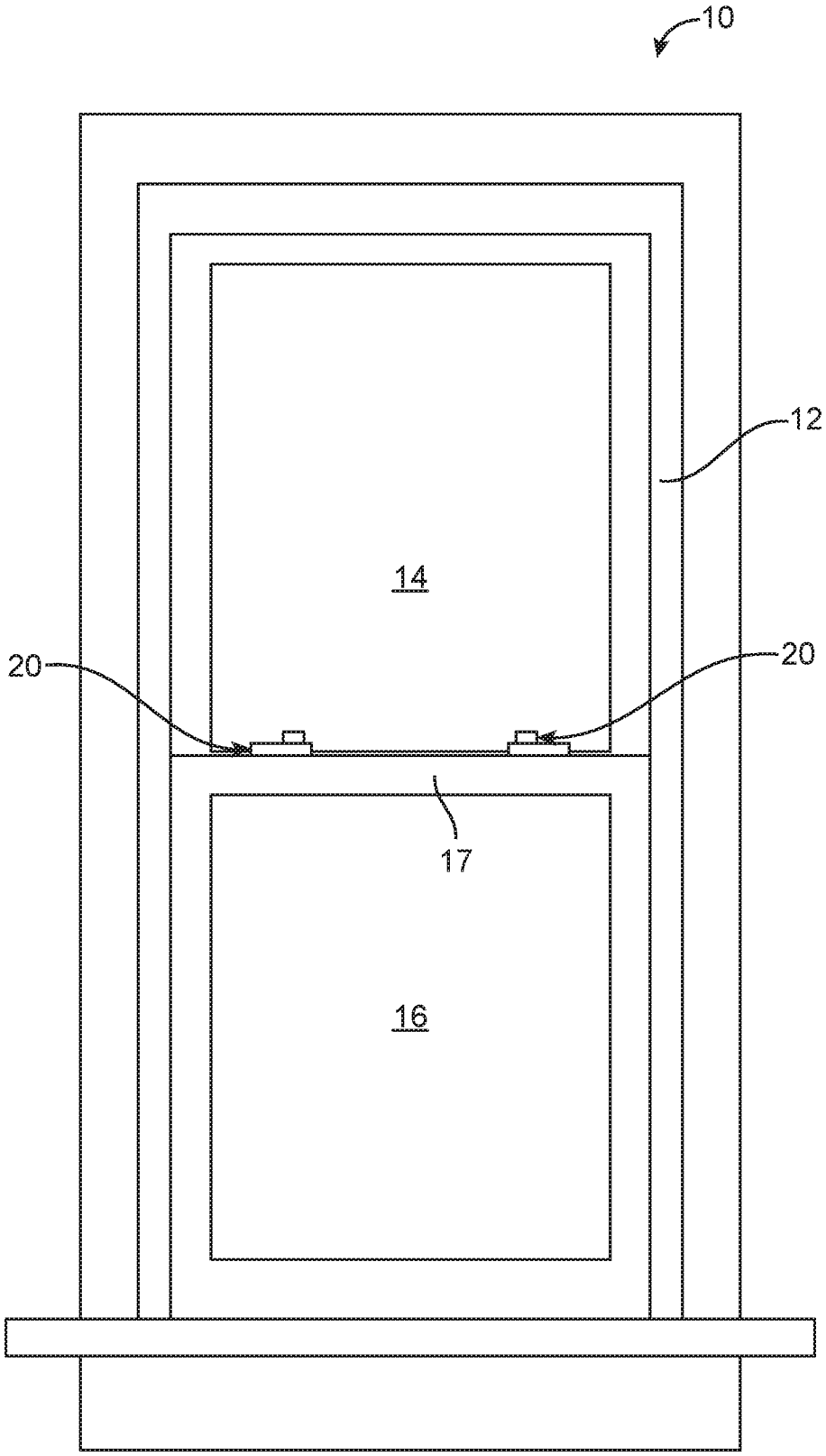
FIG. 1 depicts one illustrative embodiment of a fenestration unit with a movable panel including one illustrative embodiment of a pair of fenestration lock assemblies as described herein in which the movable panel slides within a fenestration unit frame.

In the following description of illustrative embodiments, reference is made to the accompanying figures of the drawing which form a part hereof, and in which are shown, by way of illustration, specific embodiments. It is to be understood that other embodiments may be utilized and structural changes may be made without departing from the scope of the present invention.

The fenestration lock assemblies may be used with a variety of different fenestration units that include movable panels with fenestration lock assemblies. Fenestration units in the form of windows may include one or more horizontally sliding panels (i.e., sashes), one or more vertically moving panels (in, e.g., a double hung window, a single hung window, etc.), and/or one or more rotating panels (in, e.g., a casement window, transom, etc.). Fenestration units in the form of doors may include one or more movable panels, the one or more movable panels may include one or more horizontally sliding panels (e.g., patio doors, sliding doors, gliding doors, multi-glide doors, lift and slide doors, etc.), one or more vertically movable door panels, and/or one or more rotating movable panels. The movable panels in fenestration units as described herein slide and/or rotate between closed and open positions within a fenestration unit frame. The movable panels in fenestration units described herein may include glazing panels and/or opaque panels constructed of wood or other materials.

The illustrative embodiment of fenestration unit 10 depicted in FIG. 1 is in the form of a single or double hung window including a fenestration unit frame 12 along with sashes 14 and 16. In the depicted embodiment of fenestration unit 10, the lower sash 16 carries a pair of illustrative embodiments of fenestration lock assemblies 20 on check rail 17 to lock the sashes 14 and 16 in their closed positions.

Figure 2:
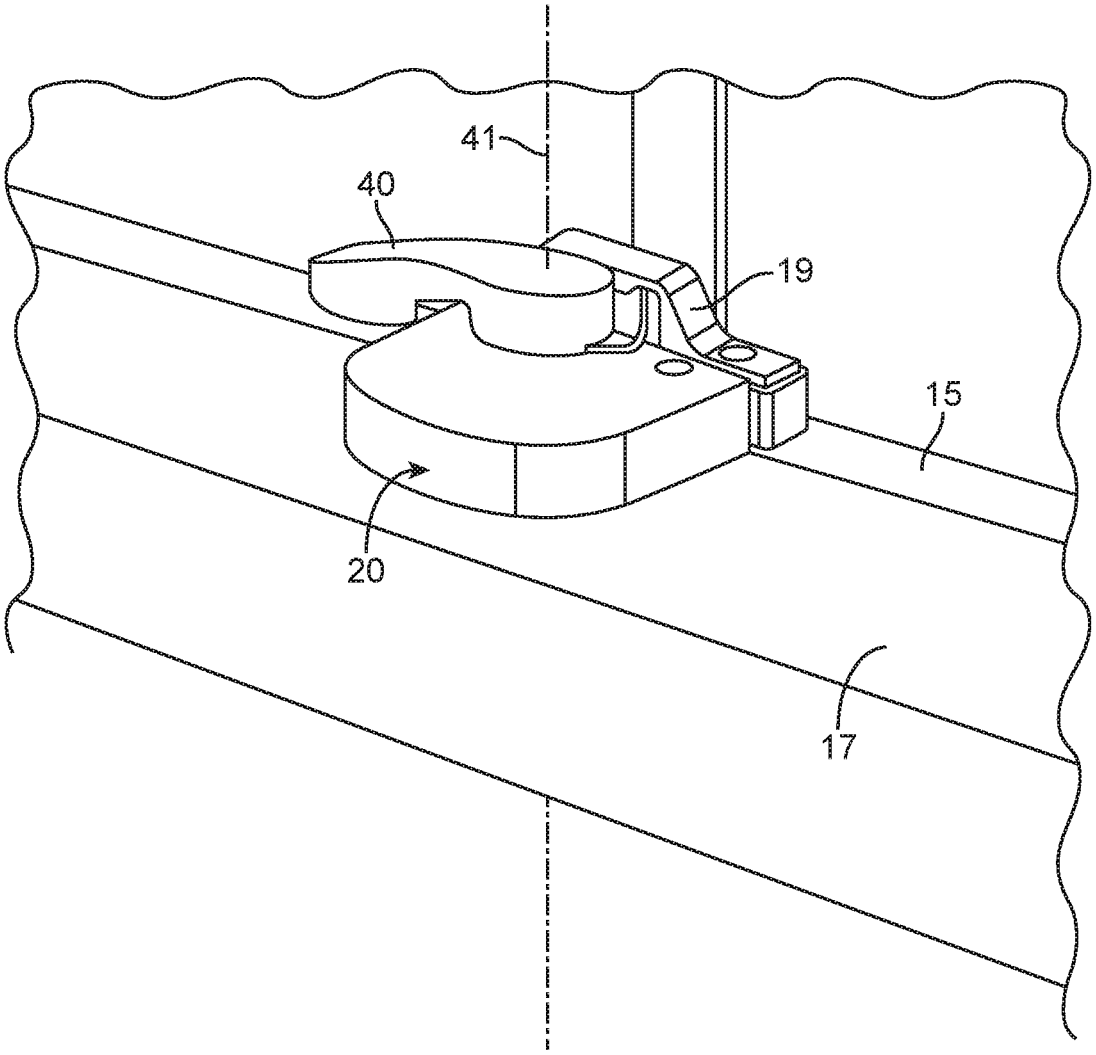
FIG. 2 is a perspective view of a portion of a panel frame member (e.g., check rail) of one illustrative embodiment a movable panel including one of the fenestration lock assemblies depicted in FIG. 1.

One of the fenestration lock assemblies 20 is depicted in an enlarged perspective view in FIG. 2 where the fenestration lock assembly 20 is mounted on check rail 17 and includes a handle 40 configured to rotate about shaft axis 41 when moving the lock assembly 20 between its locked and unlocked configurations. The lock assembly 20 is, in the depicted illustrative embodiment, configured to engage with a keeper 19 mounted on check rail 15 that forms a part of the upper sash 14 (see FIG. 1) when the sashes 14 and 16 are in their closed positions and the lock assembly is in its locked configuration. When engaged with the keeper 19, the lock assembly 20 locks the sashes 14 and 16 in their closed positions.

In one or more embodiments, all of the components of the fenestration lock assemblies described herein may be located on a check rail (i.e., the top rail of the lower sash and/or the bottom rail of the upper sash). In one of more alternative embodiments, the components of the fenestration lock assemblies described herein may be located on and/or in other portions of a fenestration unit, e.g., on and/or in another member used in the fenestration unit (e.g., a top rail, bottom rail, sill, stool, threshold, top/head jamb, side jamb, movable panel, etc.).

Figure 3:
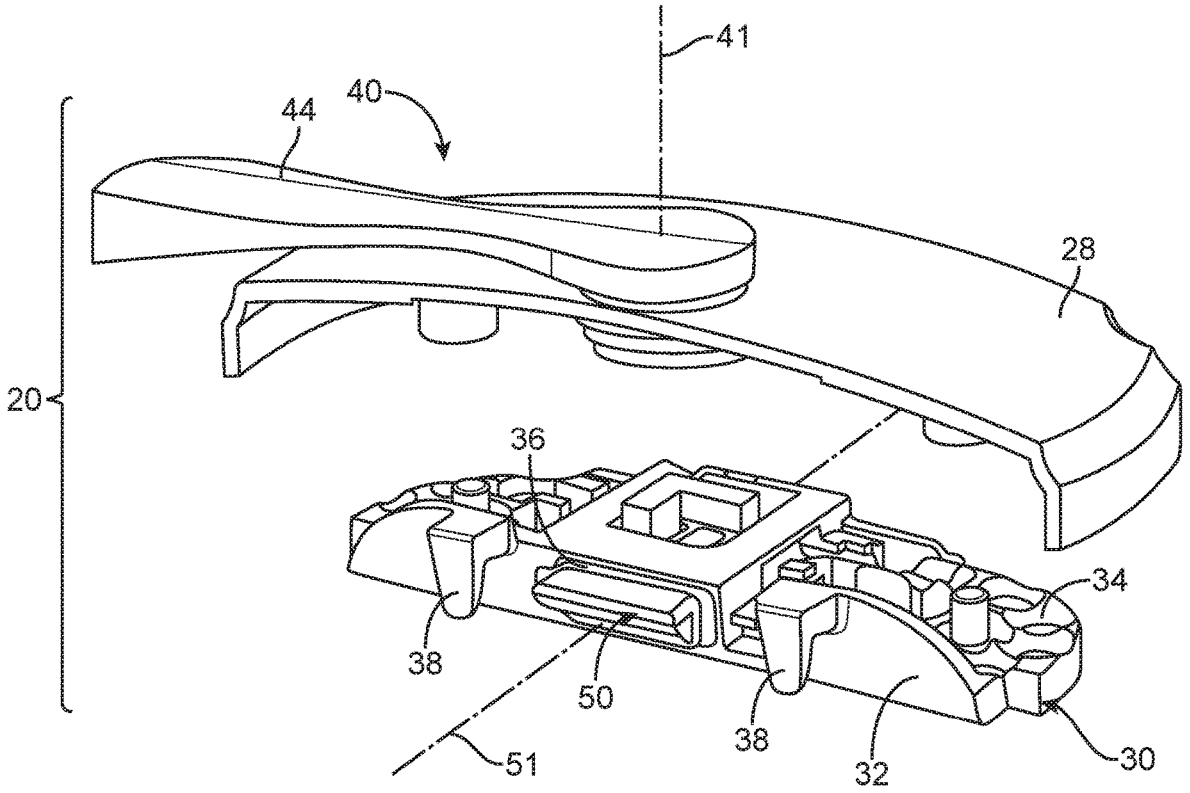
FIG. 3 is an enlarged perspective view of one illustrative embodiment of a fenestration lock assembly as described herein after removal from a fenestration unit with the cover and attached handle removed from the base.
Figure 4:
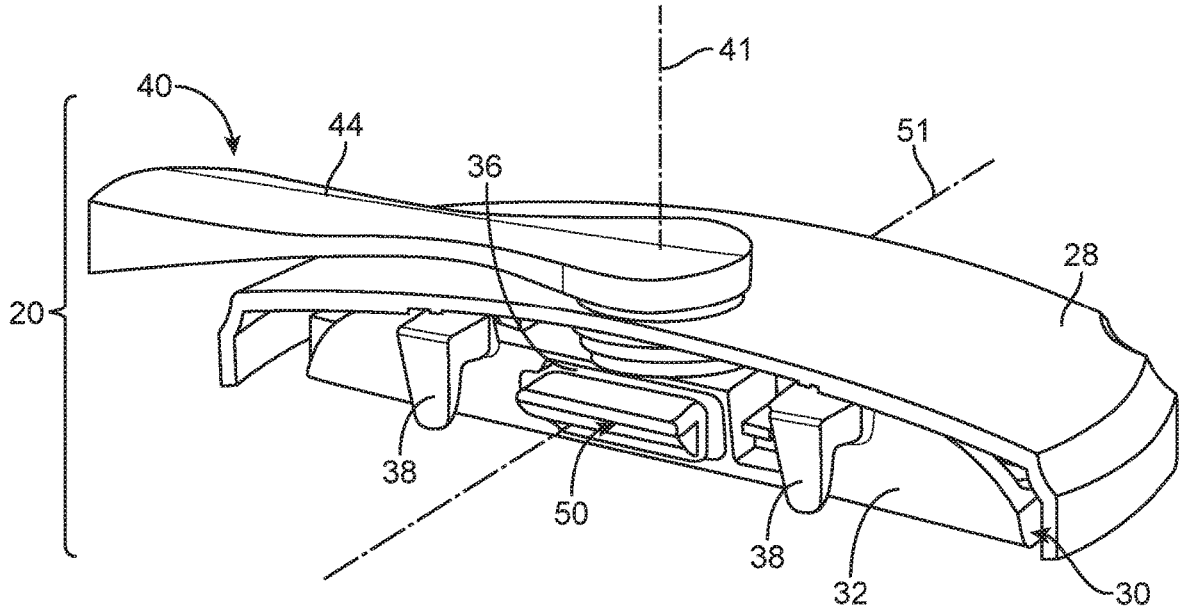
FIG. 4 depicts the fenestration lock assembly of FIG. 3 with the cover and attached handle reattached to the base.

FIGS. 3-4 are enlarged perspective views of the illustrative embodiment of a fenestration lock assembly 20 as described herein after removal from the check rail on which it was mounted (with the cover and attached handle removed from the base in FIG. 3 and reattached in FIG. 4).

The lock assembly 20 includes a housing that includes a cover 28 attached to a base 30 when the lock assembly 20 is assembled as depicted in FIG. 4. The handle 40 in the depicted illustrative embodiment is attached to the cover 28 of the housing and configured to rotate about a shaft axis 41. The base 30 includes a chassis 32 configured for attachment to a check rail or other fenestration unit frame member using, e.g., fastener openings 34 which, in the depicted embodiment, are configured to receive screws, rivets, bolts, or other mechanical fasteners to secure the chassis 32 to the frame member.

In the depicted embodiment the base 30 also includes a lock bolt passage 36 in which lock bolt 50 moves during operation of the lock assembly 20 as described herein. In the depicted illustrative embodiment, the lock bolt passage 36 is integrally formed in the chassis 32 (although in other alternative embodiments, the chassis may or may not be used to provide the lock bolt passage 36). In particular, lock bolt 50 is slidably mounted in the passage 36 and configured to move in alternate rearward and forward directions along a locking axis 51 that extends through the passage 36. In the extended position (as seen in, e.g., FIGS. 3-4) the lock bolt 50 is extended in a forward direction from the passage 36 so that the lock bolt 50 can engage a keeper, such as, e.g., keeper 19 as depicted in FIG. 2. Movement of the handle 40 around shaft axis 41 moves the lock bolt 50 along locking axis 51 to a retracted position such that the lock bolt 50 moves in the rearward direction at least partially into the passage 36 of chassis 32 of base 30 in the housing of the lock assembly 20. Retraction of the lock bolt 50 disengages the lock bolt 50 from a keeper to allow movement of sashes or other movable panels in a window or other fenestration unit.

In one or more embodiments, the shaft axis 41 and the locking axis 51 may be transverse to each other as seen in, e.g., FIGS. 3-4.

In the depicted illustrative embodiment of lock assembly 20, the base 30 also includes hooks 38 extending from chassis 32. In one or more embodiments, the hooks 38 may engage structures on the keeper (, e.g., keeper 19 as depicted in FIG. 2) to retain the frame members of a fenestration unit in close proximity to each other along locking axis 51 in the event forces are applied to the frame members of the fenestration unit to disengage the lock bolt 50 from a keeper (during, e.g., due to deformation by wind loads, an attempted break-in, etc.).

Figure 5A:
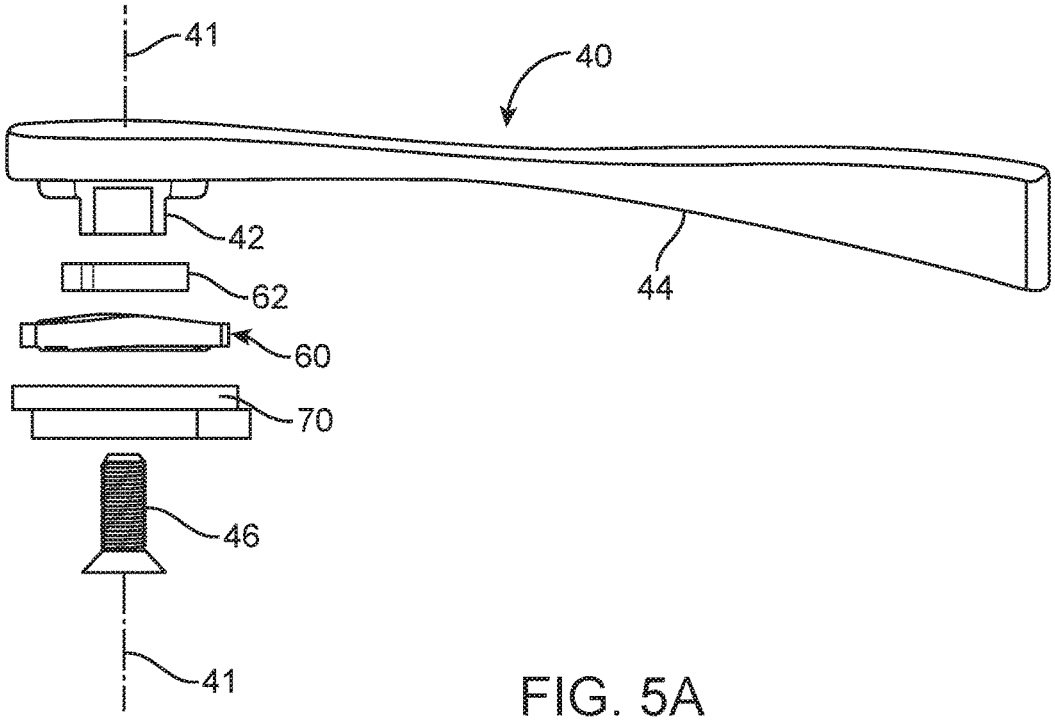
FIG. 5A is an exploded diagram of components of the fenestration lock assembly of FIG. 3 that are attached to the handle of the fenestration lock assembly.
Figure 5B:
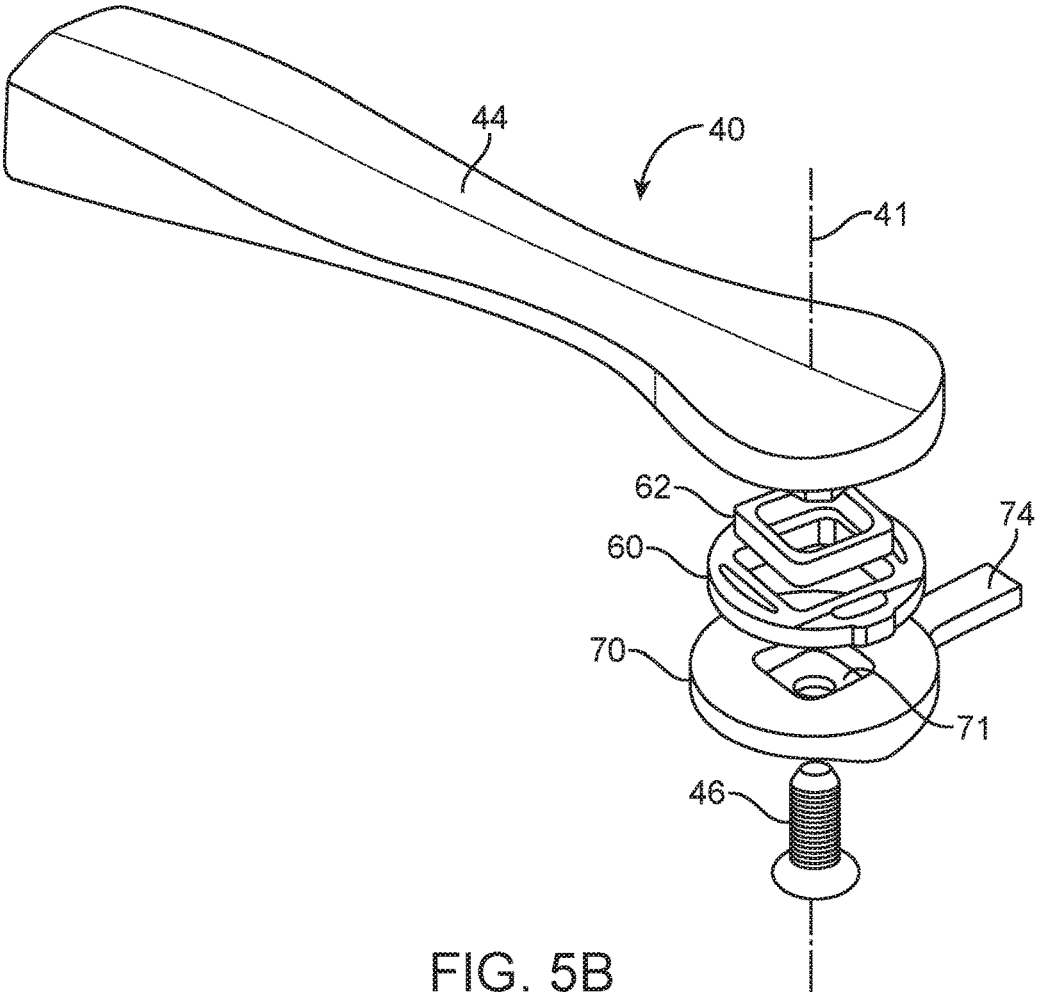
FIG. 5B is a perspective view of the exploded diagram of FIG. 5A.

FIGS. 5A-5B depict the handle 40 and components attached to the handle 40 removed from the cover 28 of the housing of the lock assembly 20 as seen in FIGS. 3-4. The handle 40 includes a shaft 42 and a lever portion 44, with the handle 40 being configured to rotate the shaft 42 about the shaft axis 41.

In the depicted illustrative embodiment, a detent washer 60 is attached to the shaft 42 of the handle 40. A detent washer insert 62 may be provided to adapt the detent washer 60 to the smaller shaft 42 of the handle 40 as needed. Because of the connection between the detent washer 60 and the shaft 42, rotation of the handle 40 about the shaft axis 41 also rotates the detent washer 60.

A rotatable cam 70 is also attached to the shaft 42 of the handle 40. Rotation of the cam 70 about the shaft axis 41 is used to move the lock bolt 50 between its retracted and extended positions as described herein. In the depicted illustrative embodiment, the cam 70 is fixedly attached to the handle 40 using both a recess 71 into which the shaft 42 extends when assembled, as well as a threaded fastener 46 used to secure the cam 70 and detent washer 60 to the handle 40. Because of the connection between the cam 70 and the shaft 42, rotation of the handle 40 about the shaft axis 41 also rotates the cam 70.

Figure 6A:
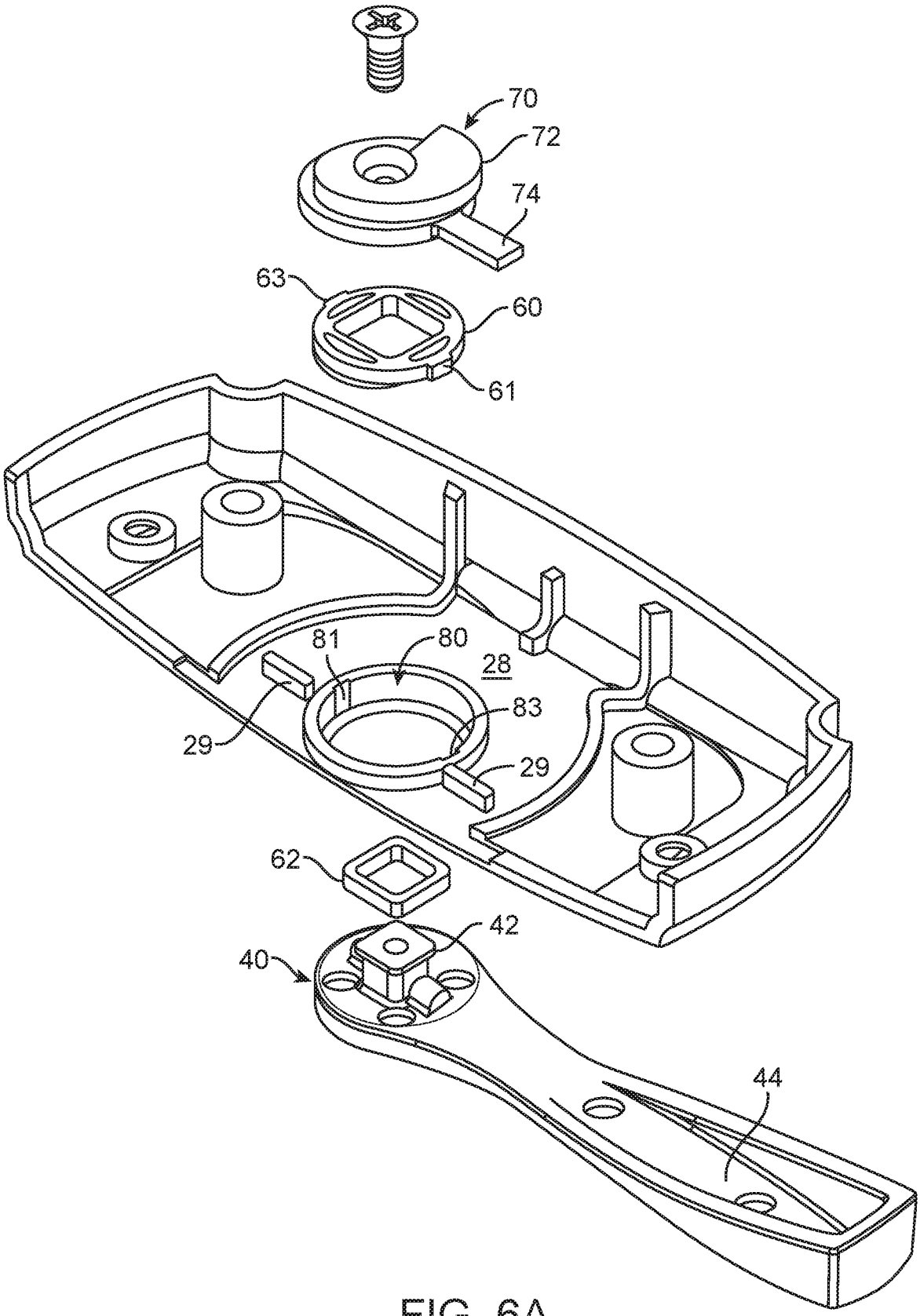
FIG. 6A is an exploded diagram of the components of the fenestration lock assembly of FIG. 5A arranged with a housing cover to which they will be attached.
Figure 6B:
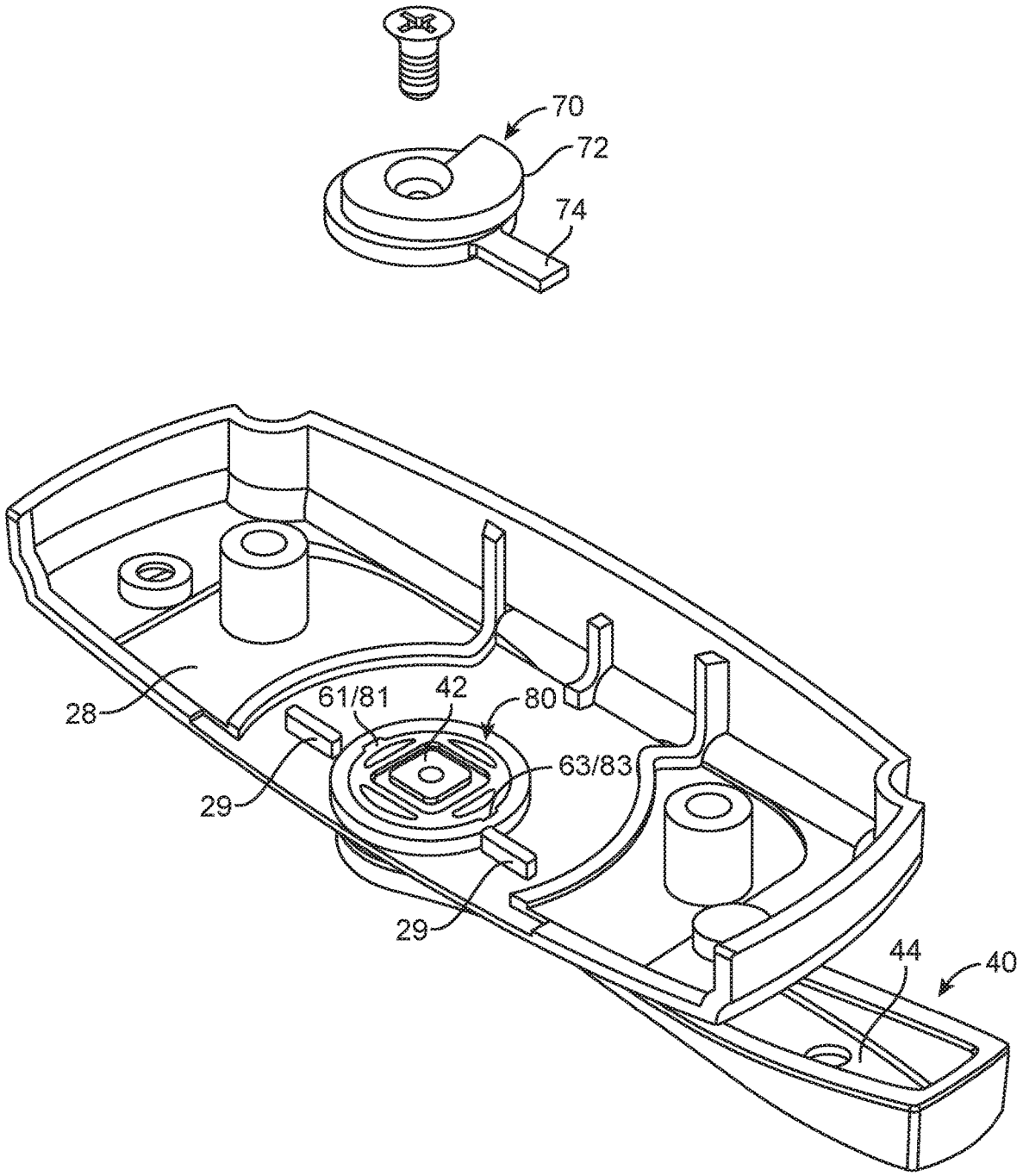
FIG. 6B is a partially exploded diagram in which some of the components of the fenestration lock assembly of FIG. 6A are assembled with the housing cover.
Figure 6C:
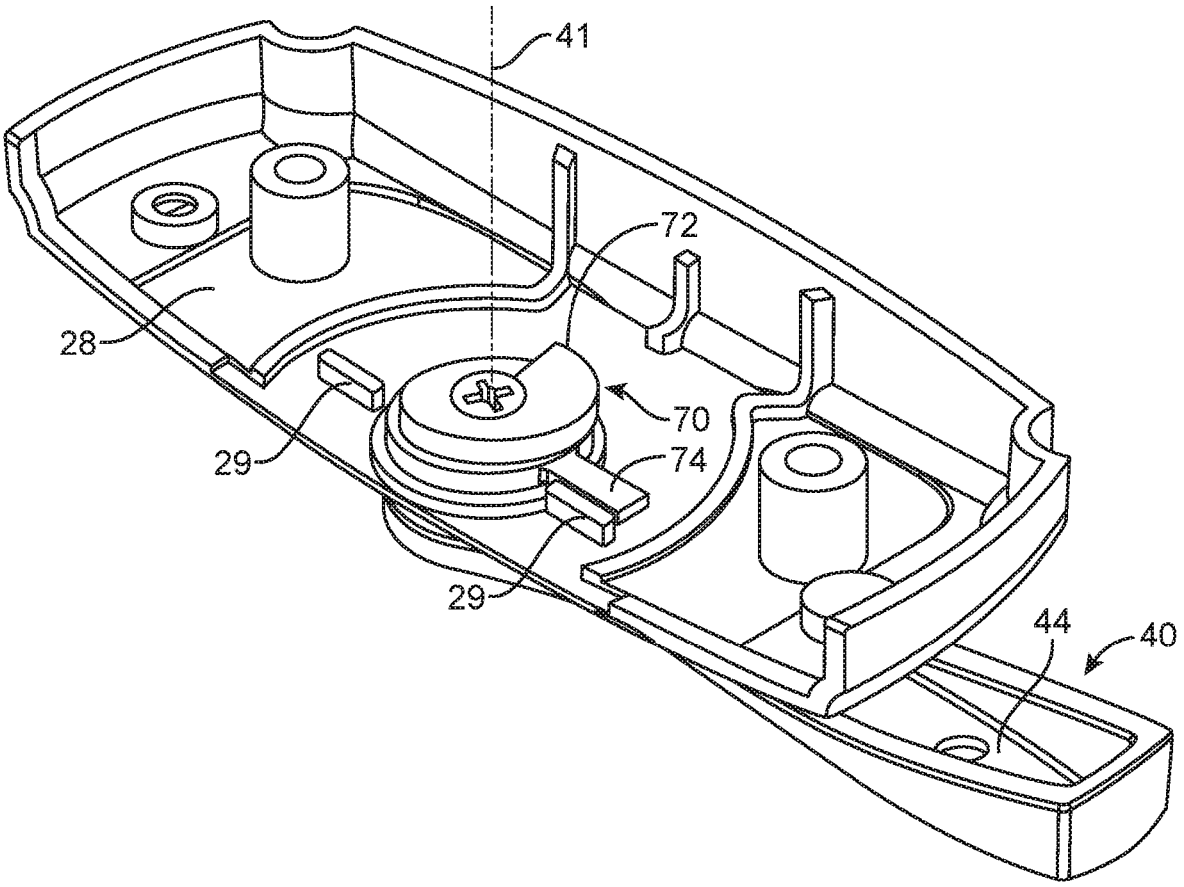
FIG. 6C is a perspective view of the components of the fenestration lock assembly of FIG. 6A assembled with the housing cover.

Referring to FIGS. 6A-6C, the components attached to the handle 40 as seen in FIGS. 5A-5B are depicted in various stages of assembly with the housing cover 28. In FIG. 6A, the handle 40, detent washer 60, and cam 70 (which includes cam surface 72) are depicted in an exploded view along with the housing cover 28. When fully assembled as seen in FIG. 6C, the detent washer 60 is retained in the detent washer cavity 80 by the cam 70. Although depicted as separate components, one or more of the components attached the handle 40 may be combined. For example, the detent washer 60 and cam 70 may be combined in a single integral part. As another example, the detent washer insert 62 may not be needed if the detent washer 60 is molded to fit directly onto the shaft 42 of the handle 40.

The depicted illustrative embodiment of housing cover 28 includes a detent washer cavity 80 configured to receive the detent washer 60. Detent washer cavity 80 includes, in the depicted illustrative embodiment, a pair of recesses 81 and 83, while the detent washer 60 includes a complementary pair of protrusions 61 and 63 with the protrusions and recesses mating with each other in two different positions as the detent washer 60 is rotated within the detent washer cavity 80 of the housing cover 28. In the depicted illustrative embodiment, rotation of the shaft 42 of the handle 40 about the shaft axis rotates the detent washer 60 about the shaft axis. The complementary protrusions and recesses provided as part of the detent washer 60 and detent washer cavity 80 function to retain the detent washer 60 in the locked or unlocked configuration in the detent washer cavity 80 until a force is applied to the handle 40 to rotate the handle 40 about the shaft axis.

In the depicted illustrative embodiment, the detent washer may be pliable or deformable such that the detent washer protrusions 61 and 63 are deflected towards the center of the detent washer (which, in the depicted illustrative embodiment, is towards the shaft axis 41—see, e.g., FIG. 5A) while the detent washer 60 is rotated about the shaft axis during operation of the depicted illustrative embodiment of a fenestration lock assembly.

Although the depicted illustrative embodiments of the detent washer 60 and the detent washer cavity 80 include protrusions 61 and 63 on detent washer 60 and recesses 81 and 83 in detent washer cavity 80, one or more alternative embodiments may include the reverse, i.e., the detent washer 60 may include recesses that mate with protrusions formed into the detent washer cavity 80. In either embodiment, the mating protrusions and recesses of the detent washer 60 and detent washer cavity 80 may provide tactile and/or audible feedback to a user when the fenestration lock assembly has reached either the locked or unlocked configuration during operation.

The depicted illustrative embodiment of housing cover 28 also includes a pair of stops 29 that, together with the stop arm 74 extending from the cam 70, limit rotation of the handle 40 about the shaft axis 41. In one or more embodiments, the stops 29 may coincide with positioning of the fenestration lock assembly in either the locked or unlocked configuration. In the depicted illustrative embodiment, the stops 29 are formed integrally with the housing cover 28, although in one or more alternative embodiments, the stops may be provided as separate elements attached to the housing cover 28. Further, although the depicted stops 29 are arranged to limit rotation of the cam 70 about an arc of approximately 180°, one or more alternative embodiments may include stops arranged to limit the rotation of the cam 70 about any suitable arc, e.g., an arc greater than 180° or an arc less than 180°.

Figure 7:
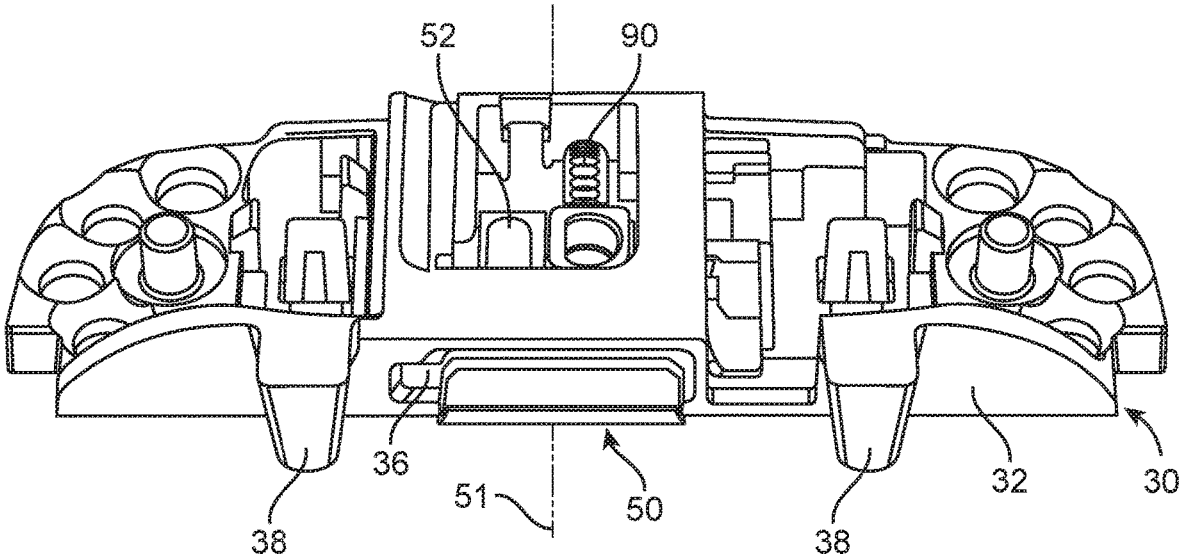
FIG. 7 is a perspective view of one illustrative embodiment of a base that may be used in a fenestration lock assembly as described herein, with one illustrative embodiment of a lock bolt of the fenestration lock assembly positioned in the base.
Figure 8:
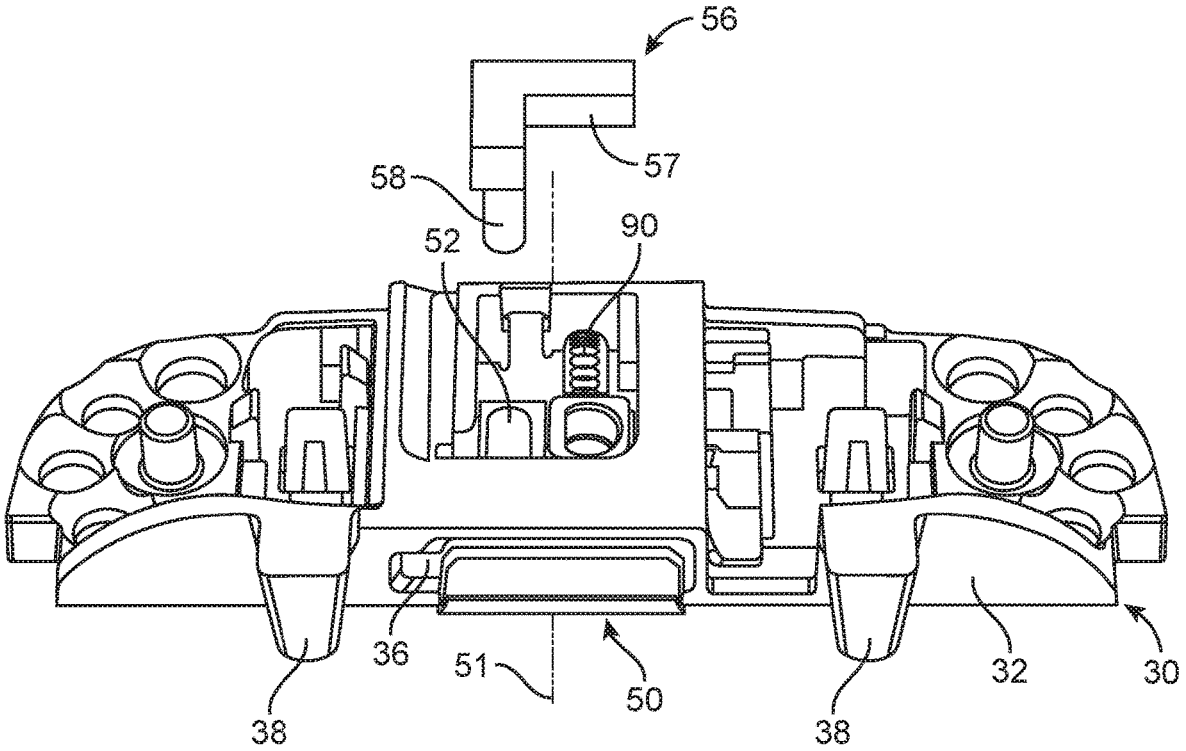
FIG. 8 is a view of the base of the fenestration lock assembly as seen in FIG. 7 with a cam follower positioned above the base for insertion into the lock bolt already contained within the base.
Figure 9:
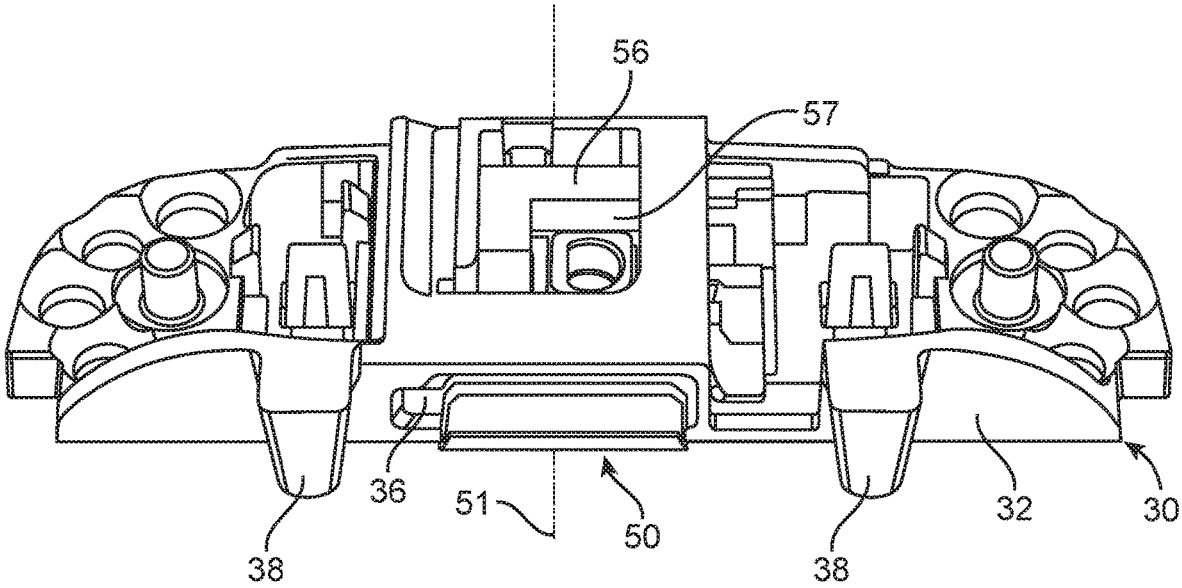
FIG. 9 is a perspective view of the base of the fenestration lock assembly of FIG. 8 after assembly of the cam follower with the lock bolt.

FIGS. 7-9 depict one illustrative embodiment of a base 30 that may be used in a fenestration lock assembly as described herein. In the depicted embodiment, an illustrative embodiment of a lock bolt 50 is positioned within a lock bolt passage 36 of the chassis 32 of base 30. As depicted, the lock bolt 50 is in its extended position such that the lock bolt 50 protrudes out of the lock bolt passage 36. In the depicted illustrative embodiment, the chassis 32 also includes hooks 38 which, as described above, may engage structures on a keeper to retain the frame members of a fenestration unit in close proximity to each other along locking axis 51 in the event forces are applied to the frame members of the fenestration unit that could potentially disengage the lock bolt 50 from a keeper.

The depicted embodiment of base 30 also includes a biasing element 90 located in the base, in particular, in the lock bolt passage 36 in the depicted embodiment. The biasing element 90 acts on the lock bolt 50 and is configured to apply a biasing force on the lock bolt 50 in a direction that moves the lock bolt 50 to the extended position as seen in FIGS. 7-9 (in the absence of a force acting in the opposite direction). In one or more embodiments, the biasing element 90 may be in the form of a coil spring as depicted, although other biasing elements such as, e.g., leaf springs, compressible pistons, compressible bladders, elastomeric elements, magnets, etc. may be used in place of a coil spring.

The depicted embodiment of base 30 also includes a cam follower 56 in FIGS. 8-9 (the cam follower 56 shown in position before assembly with the lock bolt 50 in FIG. 8 and shown after assembly with the lock bolt 50 in FIG. 9). The cam follower 56 includes a cam surface 57 positioned such that the cam surface 72 of rotatable cam 70 (see, e.g., FIGS. 6A-6C) acts on the cam surface 57 of follower 56 as the rotatable cam 70 rotates about the shaft axis as described herein.

With reference to FIG. 8, the depicted illustrative embodiment of cam follower 56 includes a pin 58 configured to be received in a recess 52 of the lock bolt 50. In one or more embodiments, the pin 58 acts on the recess 52 of the lock bolt 50 to move the lock bolt 50 between its retracted and extended positions along the locking axis 51 as the cam of the fenestration lock assembly rotates about the shaft axis as described herein. Together, the rotatable cam and the cam follower convert rotational motion of the handle of a fenestration lock assembly about the shaft axis to straight line or translational motion of the cam follower and lock bolt along the locking axis. Although the depicted illustrative embodiment includes a separate cam follower 56 that interfaces with lock bolt 50 to move the lock bolt 50 between its retracted and extended positions as described herein, in one or more alternative embodiments, the cam follower 56 and lock bolt 50 could be integrated into a single integral component.

Figure 10:
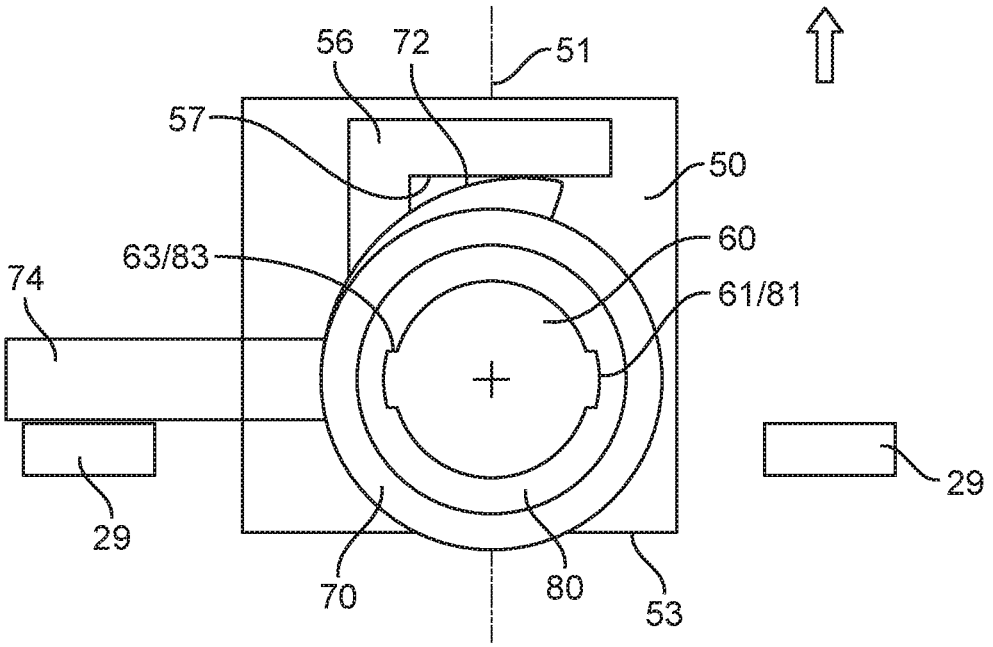
FIG. 10 is a schematic diagram depicting one illustrative embodiment of each of a detent washer, detent washer cavity, rotatable cam, lock bolt, cam follower, and pair of stops, all of which are arranged in a configuration in which the lock bolt is in its retracted position.
Figure 11:
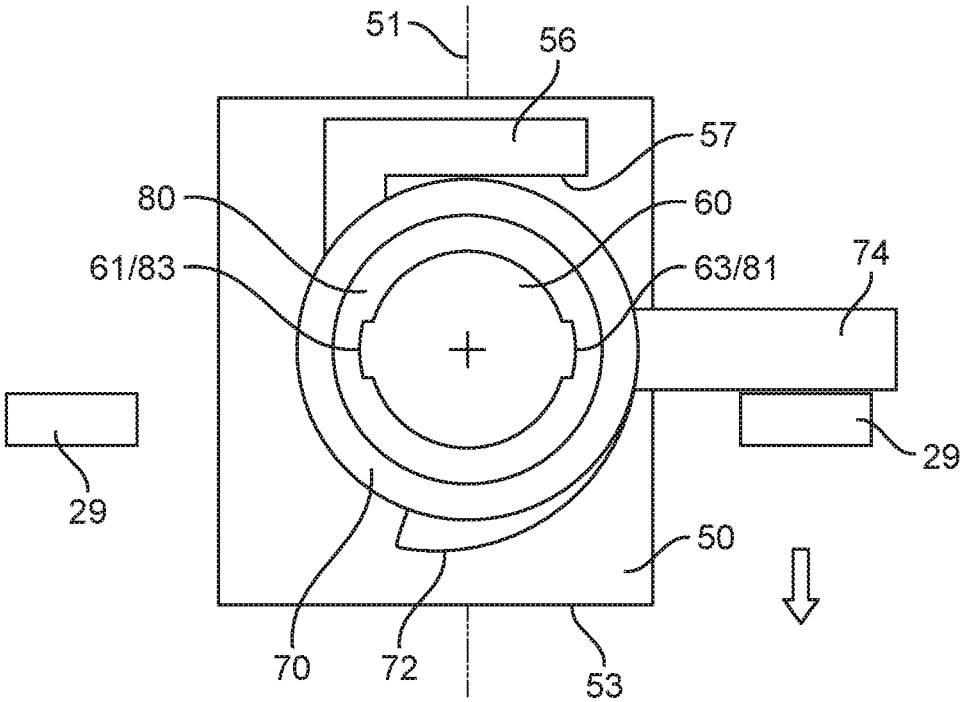
FIG. 11 is a schematic diagram depicting the components of FIG. 10 after rotation of the rotatable cam such that all of the components are arranged in a configuration in which the lock bolt is in its extended position.

FIGS. 10-11 are schematic diagrams depicting one illustrative embodiment of each of a detent washer 60, detent washer cavity 80, rotatable cam 70, lock bolt 50, cam follower 56, and pair of stops 29, arranged in a configuration in which the lock bolt 50 is in its retracted position in FIG. 10 and in a configuration in which the lock bolt 50 is in the extended position in FIG. 11. When the lock bolt 50 is in its retracted position as seen in FIG. 10, the leading edge 53 of the lock bolt 50 is located closer to shaft axis 41, while the leading edge 53 of the lock bolt 50 is located further away from the shaft axis 41 when the lock bolt 50 is in its extended position as seen in FIG. 11. As described herein, the fenestration lock assemblies are in a locked configuration when the lock bolt is in the extended position as seen in FIG. 11 and in the unlocked configuration when the lock bolt is in its retracted position as seen in FIG. 10.

With reference to FIG. 10 in which the lock bolt 50 is in its retracted position such that the fenestration lock assembly including lock bolt 50 is in its unlocked configuration, the cam 70 is rotated such that cam surface 72 forces cam follower 56 in the direction of the arrow seen in FIG. 10. In particular, cam surface 72 acts on follower surface 57 to move cam follower 56 in the direction of the depicted arrow along the locking axis 51. As described herein, the rotatable cam 70 may include a stop arm 74. In the diagram depicted in FIG. 10, the stop arm 74 is positioned against the right side stop 29 which limits for the rotation of the rotatable cam 70 in the clockwise direction. In that position, the protrusions 61 and 63 on detent washer 60 are located within corresponding recesses 81 and 83 of detent washer cavity 80.

As discussed above, one or more embodiments of fenestration lock assemblies may include a biasing element (not shown in FIGS. 10-11) that provides a force that biases the lock bolt 50 in its extended position. In other words, the biasing element would provide a force that acts on the lock bolt in a direction opposite of the arrow as depicted in FIG. 10.

In one or more embodiments in which a detent washer and detent washer cavity (such as, e.g., detent washer 60 and detent washer cavity 80) are provided to retain the fenestration lock assembly in either its locked configuration or unlocked configuration, the biasing force provided by a biasing element alone cannot cause the cam 70 to rotate an attached handle from the unlocked position to the locked position. In one or more embodiments, the biasing force provided by biasing element alone cannot cause the cam 70 to rotate an attached handle from the locked position to the unlocked position. In one or more embodiments, the biasing force provided by the biasing element alone cannot cause the cam 70 to rotate an attached handle from the locked position to the unlocked position or from the unlocked position to the locked position.

FIG. 11 depicts the components of FIG. 10 after rotation of the detent washer 60 and cam 70 about the shaft axis 41 in the counterclockwise direction to a position in which the stop arm 74 is located against the left side stop 29 which, as described herein, prevents further rotation of the cam 70 in the counterclockwise direction. The detent washer 60 has also been rotated in the counterclockwise direction about the shaft axis 41 such that protrusion 61 now mates with recess 83 in detent washer cavity 80 and protrusion 63 mates with recess 81 of the detent washer cavity 80. Lock bolt 50 is moved in the direction of the arrow depicted in FIG. 11 such that it's leading edge 53 is now located further away from the shaft axis 41 as compared to its position in FIG. 10. Because cam follower 56 is linked with lock bolt 50, cam follower surface 57 of cam follower 56 is located closer to the shaft axis 41 as compared to its position in FIG. 10.

As described above, the biasing element provides a force that urges the lock bolt 50 into the extended position depicted in FIG. 11 which corresponds with the locked configuration for the fenestration lock assembly.

The complete disclosure of the patents, patent documents, and publications identified herein are incorporated by reference in their entirety as if each were individually incorporated. To the extent there is a conflict or discrepancy between this document and the disclosure in any such incorporated document, this document will control.

Illustrative embodiments of the fenestration lock assemblies, fenestration units and methods of assembling the same are discussed herein with some possible variations described. These and other variations and modifications in the invention will be apparent to those skilled in the art without departing from the scope of the invention, and it should be understood that this invention is not limited to the illustrative embodiments set forth herein. Accordingly, the invention is to be limited only by the claims provided below and equivalents thereof. It should also be understood that this invention also may be suitably practiced in the absence of any element not specifically disclosed as necessary herein.

What is claimed is:

1. A fenestration lock assembly for securing a first frame member of a fenestration unit to a keeper attached to a second frame member of the fenestration unit and thereby preventing a relative adjustment of the first and second frame members in a first direction of motion, the lock assembly comprising:

a housing comprising a base and a cover, the housing configured to be secured to the first window frame member and defining an internal space;

a lock bolt slidably mounted in the internal space of the housing and configured to move in alternate rearward and forward directions along a locking axis between a retracted position and an extended position, the lock bolt in the extended position configured to extend in the forward direction from the housing to engage the keeper, and the lock bolt in the retracted position configured to retract in the rearward direction at least partially into the housing to disengage the keeper;

a rotatable handle operably connected to the cover of the housing, the handle comprising a shaft and a lever portion, the handle configured to rotate the shaft about a shaft axis as the handle portion rotates about the shaft axis, wherein the shaft axis is generally transverse to the locking axis;

a rotatable cam connected to the shaft of the handle, wherein the cam is configured to rotate about the shaft axis with the shaft as the lever portion of the handle is rotated about the shaft axis; and a follower in the internal space of the housing, wherein rotation of the cam about the shaft axis moves the follower along the locking axis, and wherein the follower moves the lock bolt between the retracted position and the extended position along the locking axis as the cam rotates about the shaft axis, wherein the cam comprises a stop arm extending away from the shaft axis in a generally radial direction, and wherein the housing comprises a first stop positioned such that the first stop limits further rotation of the handle as the handle is rotated from the locked position to the unlocked position, and wherein the housing comprises a second stop positioned such that the first stop limits further rotation of the handle as the handle is rotated from the unlocked position to the locked position.

2. A fenestration lock assembly according to claim 1, wherein the rotatable handle is configured to rotate about the shaft axis between an unlocked position and a locked position, wherein the lock bolt is in the retracted position when the handle is in the unlocked position, and wherein the lock bolt is in the extended position when the handle is in the locked position.

3. A fenestration lock assembly according to claim 1, wherein the first stop and the second stop extend from the cover towards the base of the housing.

4. A fenestration lock assembly according to claim 1, wherein the fenestration lock assembly comprises a biasing element located in the base of the housing, the biasing element acting on the lock bolt and configured to apply a biasing force on the lock bolt in a direction that moves the lock bolt to the extended position.

5. A fenestration lock assembly according to claim 4, wherein the biasing force alone cannot cause the cam to rotate the handle from the unlocked position to the locked position.

6. A fenestration lock assembly according to claim 4, wherein the biasing element comprises a coil spring.

7. A fenestration lock assembly according to claim 1, wherein the follower is separate and discrete from the lock bolt.

8. A fenestration lock assembly according to claim 1, wherein the follower comprises a pin, and wherein the pin is received in a recess in the lock bolt, wherein the pin of the follower acts on the recess of the lock bolt to move the lock bolt between the retracted position and the extended position along the locking axis as the cam rotates about the cam axis.

9. A fenestration lock assembly according to claim 1, wherein the fenestration lock assembly further comprises a detent washer connected to the shaft of the handle such that rotation of the shaft about the shaft axis rotates the detent washer about the shaft axis, wherein the housing comprises a detent washer cavity in which the detent washer is located, wherein the detent washer is retained in a locked configuration in the detent washer cavity when the lock bolt is in the extended position until the handle is manually rotated about the shaft axis; and wherein the detent washer is retained in an unlocked configuration in the detent washer cavity when the lock bolt is in the retracted position until the handle is manually rotated about the shaft axis.

10. A fenestration lock assembly according to claim 9, wherein the detent washer and the detent washer cavity comprise complementary mating protrusions and recesses that mate when the detent washer and the detent washer cavity are retained in the locked configuration and when detent washer is retained in the unlocked configuration in the detent washer cavity.

11. A fenestration lock assembly according to claim 10, wherein the detent washer and the detent washer cavity comprise complementary mating protrusions and recesses that do not mate when the detent washer is not in the locked configuration or the unlocked configuration in the detent washer cavity.

12. A fenestration lock assembly for securing a first frame member of a fenestration unit to a keeper attached to a second frame member of the fenestration unit and thereby preventing a relative adjustment of the first and second frame members in a first direction of motion, the lock assembly comprising:

a housing comprising a base and a cover, the housing configured to be secured to the first window frame member and defining an internal space;

a lock bolt slidably mounted in the internal space of the housing and configured to move in alternate rearward and forward directions along a locking axis between a retracted position and an extended position, the lock bolt in the extended position configured to extend in the forward direction from the housing to engage the keeper, and the lock bolt in the retracted position configured to retract in the rearward direction at least partially into the housing to disengage the keeper;

a rotatable handle operably connected to the cover of the housing, the handle comprising a shaft and a lever portion, the handle configured to rotate the shaft about a shaft axis as the handle portion rotates about the shaft axis, wherein the shaft axis is generally transverse to the locking axis;

a rotatable cam connected to the shaft of the handle, wherein the cam is configured to rotate about the shaft axis with the shaft as the lever portion of the handle is rotated about the shaft axis;

a follower in the internal space of the housing, wherein rotation of the cam about the shaft axis slides the follower along the locking axis, and wherein the follower moves the lock bolt between the retracted position and the extended position along the locking axis as the cam rotates about the shaft axis;

a detent washer connected to the shaft of the handle such that rotation of the shaft about the shaft axis rotates the detent washer about the shaft axis;

a detent washer cavity in the housing, wherein the detent washer is located in the detent washer cavity, and wherein the detent washer is retained in a locked configuration in the detent washer cavity when the lock bolt is in the extended position until the handle is manually rotated about the shaft axis; and wherein the detent washer is retained in an unlocked configuration in the detent washer cavity when the lock bolt is in the retracted position until the handle is manually rotated about the shaft axis; and a biasing element located in the base of the housing, the biasing element acting on the lock bolt and configured to apply a biasing force on the lock bolt in a direction that moves the lock bolt to the extended position, and wherein the biasing force alone cannot move the detent washer and the detent washer cavity out of the unlocked configuration, and wherein the cam comprises a stop arm extending away from the shaft axis in a generally radial direction, and wherein the housing comprises a first stop positioned such that the first stop limits further rotation of the handle as the handle is rotated from the locked position to the unlocked position, and wherein the housing comprises a second stop positioned such that the first stop limits further rotation of the handle as the handle is rotated from the unlocked position to the locked position.

13. A fenestration lock assembly according to claim 12, wherein the rotatable handle is configured to rotate about the shaft axis between an unlocked position and a locked position, wherein the lock bolt is in the retracted position when the handle is in the unlocked position, and wherein the lock bolt is in the extended position when the handle is in the locked position.

14. A fenestration lock assembly according to claim 12, wherein the first stop and the second stop extend from the cover towards the base of the housing.

15. A fenestration lock assembly according to claim 12, wherein the biasing element comprises a coil spring.

16. A fenestration lock assembly according to claim 12, wherein the follower is separate and discrete from the lock bolt.

17. A fenestration lock assembly according to claim 12, wherein the follower comprises a pin, and wherein the pin is received in a recess in the lock bolt, wherein the pin of the follower acts on the recess of the lock bolt to move the lock bolt between the retracted position and the extended position along the locking axis as the cam rotates about the cam axis.

18. A fenestration lock assembly according to claim 12, wherein the detent washer and the detent washer cavity comprise complementary mating protrusions and recesses that mate when the detent washer is retained in the locked configuration in the detent washer cavity and when the detent washer is retained in the unlocked configuration in the detent washer cavity.

19. A fenestration lock assembly according to claim 18, wherein the detent washer and the detent washer cavity comprise complementary mating protrusions and recesses that do not mate when the detent washer is not in the locked configuration or the unlocked configuration in the detent washer cavity.

20. A fenestration lock assembly for securing a first frame member of a fenestration unit to a keeper attached to a second frame member of the fenestration unit and thereby preventing a relative adjustment of the first and second frame members in a first direction of motion, the lock assembly comprising:

a housing comprising a base and a cover, the housing configured to be secured to the first window frame member and defining an internal space;

a lock bolt slidably mounted in the internal space of the housing and configured to move in alternate rearward and forward directions along a locking axis between a retracted position and an extended position, the lock bolt in the extended position configured to extend in the forward direction from the housing to engage the keeper, and the lock bolt in the retracted position configured to retract in the rearward direction at least partially into the housing to disengage the keeper;

a rotatable handle operably connected to the cover of the housing, the handle comprising a shaft and a lever portion, the handle configured to rotate the shaft about a shaft axis as the handle portion rotates about the shaft axis, wherein the shaft axis is generally transverse to the locking axis;

a rotatable cam connected to the shaft of the handle, wherein the cam is configured to rotate about the shaft axis with the shaft as the lever portion of the handle is rotated about the shaft axis; and a follower in the internal space of the housing, wherein rotation of the cam about the shaft axis moves the follower along the locking axis, and wherein the follower moves the lock bolt between the retracted position and the extended position along the locking axis as the cam rotates about the shaft axis, wherein the cam comprises a stop arm extending away from the shaft axis in a generally radial direction, and wherein the housing comprises a first stop positioned such that the first stop limits further rotation of the handle as the handle is rotated from the locked position to the unlocked position, and wherein the housing comprises a second stop positioned such that the first stop limits further rotation of the handle as the handle is rotated from the unlocked position to the locked position;

wherein the rotatable handle is configured to rotate about the shaft axis between an unlocked position and a locked position, wherein the lock bolt is in the retracted position when the handle is in the unlocked position, and wherein the lock bolt is in the extended position when the handle is in the locked position;

wherein the first stop and the second stop extend from the cover towards the base of the housing;

wherein the fenestration lock assembly comprises a biasing element located in the base of the housing, the biasing element acting on the lock bolt and configured to apply a biasing force on the lock bolt in a direction that moves the lock bolt to the extended position;

and wherein the biasing force alone cannot cause the cam to rotate the handle from the unlocked position to the locked position.

* * * * *